US005907916A

United States Patent [19]

Hahnewald et al.

[11] Patent Number: 5,907,916

[45] Date of Patent: Jun. 1, 1999

[54] SMOOTHING IRON WITH ADHERED SOLEPLATE

[75] Inventors: Andrea Hahnewald, Dreieich, Germany; Francesc Carreras Devesa; Juan Carlos Coronado Sanz, both of Barcelona, Spain; Antonio Rebordosa, Manresa, Spain; Miguel Vazquez Palma, Barcelona, Spain

[73] Assignee: Braun Aktiengesellschaft, Germany

[21] Appl. No.: 08/918,270

[22] Filed: Aug. 25, 1997

[30] Foreign Application Priority Data

Mar. 9, 1995 [DE] Germany ..... 195 08 446
Feb. 23, 1996 [WO] WIPO ..... PCTEP9600746

[51] Int. Cl.[6] ..... D06F 75/38
[52] U.S. Cl. ..... 38/93
[58] Field of Search ..... 38/93, 97, 81, 38/88; 156/60, 292

[56] References Cited

U.S. PATENT DOCUMENTS

| | | | |
|---|---|---|---|
| 2,257,451 | 9/1941 | Barnes | 38/93 X |
| 2,552,988 | 5/1951 | Machanic | 38/93 X |
| 4,115,935 | 9/1978 | Toft | 38/88 |
| 5,146,700 | 9/1992 | Prosser | 38/93 X |
| 5,619,813 | 4/1997 | Forest et al. | 38/93 |
| 5,749,165 | 5/1998 | Schonborn et al. | 38/93 X |

FOREIGN PATENT DOCUMENTS

| | | | |
|---|---|---|---|
| 556721 | 8/1993 | European Pat. Off. | 38/93 |
| A 2 648 166 | 12/1990 | France . | |
| 94 01 094 | 5/1994 | Germany . | |
| 1203145 | 8/1970 | United Kingdom | 38/93 |
| A 2 225 345 | 5/1990 | United Kingdom . | |

*Primary Examiner*—Ismael Izaguirre
*Attorney, Agent, or Firm*—Fish & Richardson P.C.

[57] ABSTRACT

The invention is directed to a smoothing iron having a shoe and a soleplate, in which the shoe and the soleplate are joined to each other by an adhesive. The spacing between the shoe and the soleplate varies across the shoe. The space between the shoe and the soleplate is filled with the adhesive. No prior mechanical treatment or heating of the shoe and/or the soleplate is required.

15 Claims, 1 Drawing Sheet

SMOOTHING IRON WITH ADHERED SOLEPLATE

BACKGROUND OF THE INVENTION

This invention relates to a smoothing iron with a shoe and a soleplate that are connected with each other with an adhesive.

A smoothing iron of this type is known in which the iron's shoe is cast. Then a soleplate is fastened to the shoe. For fastening, applicant has knowledge of a variety of approaches. For example, the soleplate may be riveted to the shoe, such riveting being in particular possible in a steam discharge port of the soleplate. In addition, the possibility exists to weld bolts to the soleplate which pass through the shoe. These bolts may then be caulked to the shoe or alternatively, they may be provided with a thread in which case the connection between the shoe and the soleplate is established by means of a nut engaging the bolt. Equally, the shoe and the soleplate may also be welded together—as by means of a laser beam. Apart from these types of fastening, it is also known from GB-A-2 225 345 to secure a soleplate member and a cover plate together by means of an adhesive—for example, on silicone basis. These joining methods may also be applied in combination.

It is an object of the present invention to improve the attachment of a soleplate to a shoe of a smoothing iron.

SUMMARY OF THE INVENTION

According to the present invention, this object is accomplished by changing the spacing between the shoe and the soleplate across the are of the shoe.

As becomes apparent, this invention is capable of solving hitherto existing problems in a surprisingly simple manner. In the securing of the shoe to the soleplate, difficulties reside in that the fastening of the shoe to the soleplate presents problems in cases where adhesive bonding over a surface area is chosen, because mechanical stresses may occur due to different coefficients of thermal expansion of the shoe and the soleplate. Also, mechanical stresses may occur in cases where the soleplate's smoothing surface is coated. The coating preferably serves the purpose of imparting higher hardness and improved sliding ability to the smoothing surface. However, the coating may have a coefficient of thermal expansion that differs from that of the soleplate material. In this case, a bimetal effect occurs, that is, the soleplate experiences a deflection.

The adhesive which is preferably an adhesive on the basis of silicone has a certain elasticity also in dried or cured condition. With different relative distances of the shoe to the soleplate at different locations, the elasticity of the joint between the shoe and the soleplate at these different locations is also different. Where this distance is wider, a thicker adhesive layer between the shoe and the soleplate results. Because of this thicker adhesive layer and the adhesive's elasticity, the joint between the shoe and the soleplate has at these locations a higher elasticity than at the locations where the adhesive layer is thinner. Accordingly, by proper arrangement of these different relative distances of the shoe to the soleplate, it is possible for the shoe and the soleplate to operate in opposition to each other when heated, without this impairing the durability of the adhesive bond between the shoe and the soleplate. This has a particularly advantageous effect when the soleplate has a bimetal effect on heating and/or has a coefficient of thermal expansion differing from that of the shoe.

Advantageously, therefore, the different relative distances are dimensioned such that at the locations where a wider distance occurs between the soleplate and the shoe because of a bimetal effect of the soleplate upon heating, the relative distance of the shoe to the soleplate is wider also in unheated condition. The same applies in cases where the coefficients of thermal expansion of the shoe and the soleplate differ. Conveniently, in this case the relative distance of the shoe to the soleplate shows higher values at those locations where a larger displacement results on account of the different coefficients of thermal expansion upon heating.

According to one embodiment of the invention, a flexible connection is provided between the shoe and the soleplate, the flexibility increasing as the distance from a line increases. In the advantageous embodiment described, the flexibility increases in the longitudinal direction of the smoothing iron.

In another embodiment, starting from a line passing through the center of gravity of the iron's area, the flexibility increases in either direction away from the line.

In another advantageous configuration the flexibility of the connection between the shoe and the soleplate increases in the transverse direction of the smoothing iron.

Advantageously that, starting from this line through the center of gravity of the iron's area, the flexibility increases in either direction away from the line.

In the longitudinal direction of the lines, the distances transverse to the lines where the relative distances of the shoe to the soleplate result may have different values. Thus, for example, it is possible to make provision for a specified relative distance of the shoe to the soleplate along the outer edges of the smoothing iron. At the forward end of the iron, the specified distance then results at a smaller distance transverse to the line in the iron's longitudinal direction than at the rear end of the iron. Correspondingly, a greater distance results transversely to a line in the transverse direction of the iron in the center of this line, in which the specified relative distance of the shoe to the soleplate is achieved, than it does in the proximity of the points where this line intersects the outer edges of the smoothing iron.

In still another embodiment the additional mechanical fastening enables the shoe and the soleplate to be attached to each other in a particularly secure manner. Spot fastening or localized fastening has the advantage of enabling the shoe and the soleplate to be floatingly held in the area surrounding this mechanical fastening, thus preventing or reducing mechanical stresses.

In another embodiment, the shoe can be provided with steps, wherein the spacing between the shoe and the soleplate changes discontinuously across the steps. The spacing can be set to specific predetermined values.

In yet another embodiment it proves advantageous that a direct metal-to-metal contact exists between the shoe and the soleplate when the iron is cold or has cooled off. This ensures a particularly good heat transfer. Particularly advantageously, these locations are arranged within, or in close proximity to, the areas where the relative distance of the shoe to the soleplate is the largest. By reason of the adhesive's reduced heat transfer as compared with that obtained by metal-to-metal contact, it is thus possible to ensure good heat transfer also at locations where the heat transfer would be otherwise reduced because of the thickness of the adhesive layer. Moreover, in such a configuration of a smoothing iron it is also ensured that the shoe and the soleplate are at a constant relative distance during assembly, also when the shoe and the soleplate are pressed against each other. In this arrangement, the locations where direct contact exists between the shoe and the soleplate serve as spacing means. Deformation of the soleplate during assembly can be thereby avoided.

With the smoothing iron according to claim 10, the manufacturing process of the iron may be carried into effect particularly readily. By suitably shaping the mold of the shoe it is comparatively easy to shape the underside of the shoe correspondingly thereby greatly simplifying the manufacturing process. Advantageously, provision may be made to the effect that in a stepwise variation of the relative distance of the shoe to the soleplate the transitions between these areas do not extend vertically but are inclined at an angle of 10°, approximately, relative to the vertical, thus enabling the mold to be removed readily on completion of the casting operation.

In another advantageous embodiment, the outsides of the smoothing surface have a larger relative distance of the shoe to the soleplate is obtained than in the inward area of the smoothing surface. By arranging for the steam distribution duct to separate these two areas, the iron can be manufactured with particular ease. In addition, mechanical stresses are prevented from occurring in the transition between these areas of different elasticity of the connection between the shoe and the soleplate, because the steam distribution duct forms the transition. In the area of this steam distribution duct, there is no connection at all between the shoe and the soleplate.

In yet another embodiment good heat transfer from the shoe to the soleplate is ensured also in the outer area of the smoothing surface. Because the area of direct contact between the shoe and the soleplate adjoins the inside of the steam distribution duct, a sufficient surface area is ensured for establishing an adhesive bond in the area between the steam distribution duct and the outer edge of the smoothing surface.

BRIEF DESCRIPTION OF THE DRAWINGS

Embodiments of the present invention illustrating the basic principle are shown in the accompanying drawings in which.

DESCRIPTION OF PREFERRED EMBODIMENT

Figure 1:
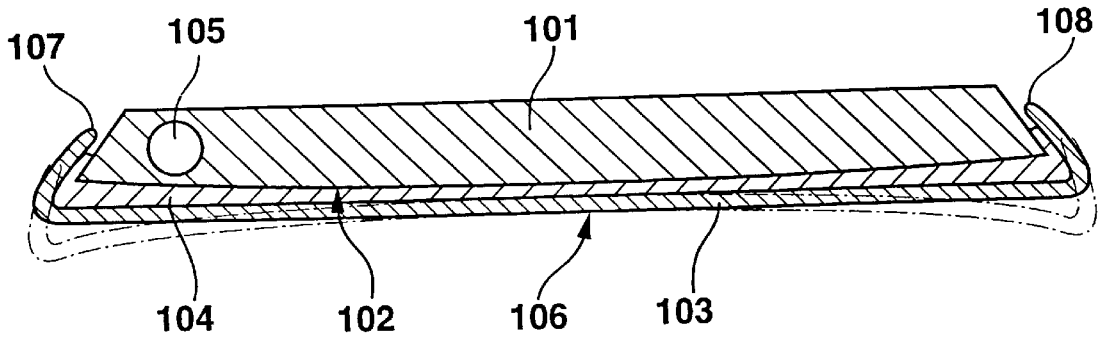
FIG. 1 is a first embodiment of a smoothing iron.

FIG. 1 is a vertical section of a smoothing iron taken in the longitudinal direction. In the illustration of FIG. 1, the iron has a shoe 101 with an underside 102 shaped in convex fashion. A soleplate 103 is joined to this shoe 101 by means of a layer of adhesive 104. Integrally cast within the shoe 101 is a heating means 105 for heating the shoe 101. The heat is transferred from the shoe 101 to the soleplate 103 whose underside 106 forms the smoothing surface. The underside 106 may be coated. In the embodiment of FIG. 1, the coating of the underside 106 has a lower coefficient of thermal expansion than the material of the soleplate 103.

As the shoe 101 is heated, transferring the heat to the soleplate 103 through the adhesive layer 104, the coefficient of thermal expansion of the coating on the underside 106 of the soleplate 103, which is lower than the coefficient of thermal expansion of the soleplate 103, causes the soleplate 103 to deflect in concave manner. This is illustrated in FIG. 1 by the dot-and-dash lines representing the soleplate 103 in heated condition. At the forward end 107 and at the rearward end 108 of the iron, the relative distance of the shoe 101 to the soleplate 103 is the largest because of the deflection. The relative distance of the shoe 101 to the soleplate 103 was the largest at these two ends also prior to the deflection of the soleplate 103 on heating. Because the adhesive layer 104 is the thickest in the area of the forward and rearward ends 107, 108 of the iron when not heated, it is precisely at these ends 107, 108 where the elasticity of the adhesive layer 104 is the highest. Accordingly, the deflection of the soleplate 103 resulting from the bimetal effect is prevented to an only lesser degree than would be the case with an adhesive layer 104 of constant thickness. Overall, therefore, the adhesive layer 104 is subjected to less mechanical stress, thus prolonging the life of the adhesive layer 104.

As becomes further apparent from FIG. 1, the location where the thickness of the adhesive layer 104 is at its minimum is relocated in the direction of the rearward end 108 of the iron as seen when looking from the center in the longitudinal direction of the iron. As a result, this location is arranged approximately in the proximity of the center of gravity of the smoothing surface area.

Figure 2:
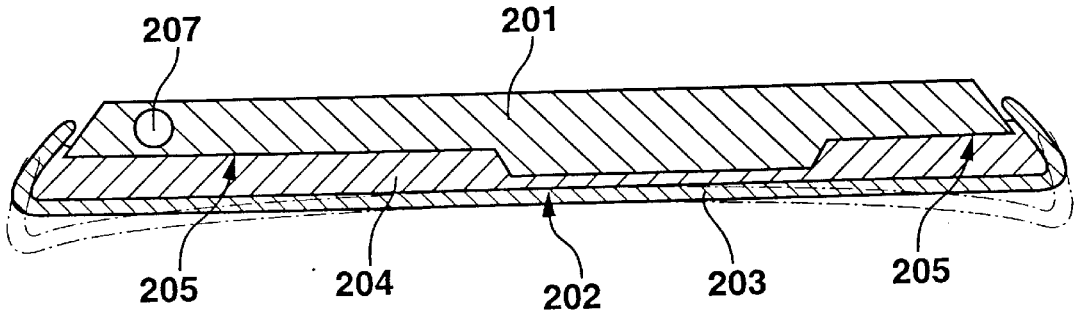
FIG. 2 is a second embodiment of a smoothing iron.

FIG. 2 shows likewise a vertical section of a smoothing iron taken in the longitudinal direction. In contrast to the representation of FIG. 1, however, the shoe 201 shown in FIG. 2 has its underside not shaped in convex manner. Rather, the iron of FIG. 2 has a first area 202 in which the shoe 201 and the soleplate 203 are disposed at a specified first relative distance, and a second area 205 in which the shoe 201 and the soleplate 203 are disposed at a specified second relative distance which is greater than the specified first distance. In this embodiment, the first area 202 extends in advantageous manner over the center of gravity of the smoothing surface area.

Secured to this shoe 201 is a soleplate 203 by means of an adhesive layer 204. Integrally cast within the shoe 201 is a heating means 207 for heating the shoe 201. The heat is transferred from the shoe 201 to the soleplate 203 whose underside forms the smoothing surface. The underside may be coated. In the embodiment of FIG. 2, the coating of the underside has a lower coefficient of thermal expansion than the material of the soleplate 203.

As the shoe 201 is heated, transferring the heat to the soleplate 203 through the adhesive layer 204, the coefficient of thermal expansion of the coating on the underside of the soleplate 203, which is lower than the coefficient of thermal expansion of the soleplate 203, causes the soleplate 203 to deflect in concave manner. This is illustrated in FIG. 2 by the dot-and-dash lines representing the soleplate 203 in heated condition. At the forward end and at the rearward end of the iron, the relative distance of the shoe 201 to the soleplate 203 is the largest because of the deflection. The relative distance of the shoe 201 to the soleplate 203 was the largest at these two ends also prior to the deflection of the soleplate 203 on heating. Because the adhesive layer 204 is the thickest in the forward and rearward areas of the iron when not heated, it is precisely in these areas where the elasticity of the adhesive layer 204 is the highest. Accordingly, the deflection of the sole-plate 203 resulting from the bimetal effect is prevented to an only lesser degree than would be the case with an adhesive layer 204 of constant thickness. Overall, therefore, the adhesive layer 204 is subjected to less mechanical stress, thus prolonging the life of the adhesive layer 204.

The slight chamfer of the edges in the transition from the first area 202 to the second area 205 has the effect of affording ease of manufacture of the shoe 201 in a mold. The chamfer of these edges in the transition region is 10°, approximately, relative to the vertical. In an extension of the embodiment of FIG. 2 shown, it is also possible to make provision for several steps, resulting in several areas each at a different relative distance of the shoe 201 to the soleplate 203.

Figure 3:
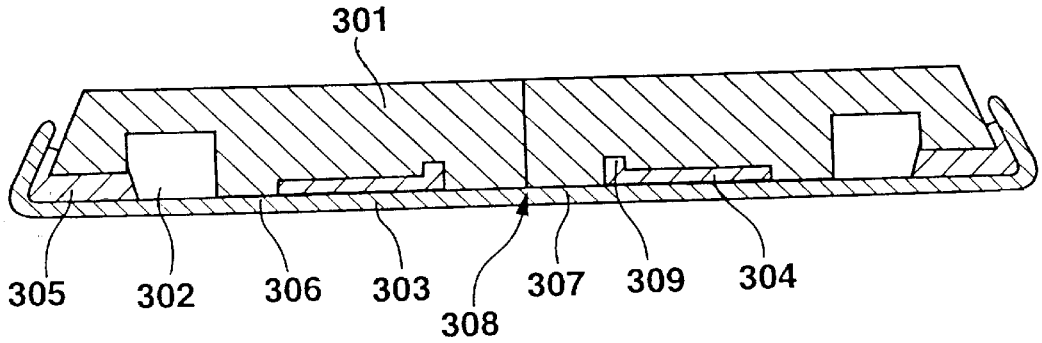
FIG. 3 is a third embodiment of a smoothing iron.

FIG. 3 shows a vertical section of a smoothing iron taken in a direction transverse to the longitudinal direction. The underside of the shoe 301 is shaped such that areas 304, 305 in which an adhesive layer is present between the shoe 301 and the soleplate 303 differ each in their relative distance of the shoe 301 to the soleplate 303. Further areas 306, 307 are formed in which the shoe 301 and the soleplate 303 are in direct contact with each other.

In the area 307, a connection exists between the shoe 301 and the soleplate 303 at the joint 308. In the embodiment of FIG. 3 shown, this joint is produced by a laser beam welding technique. In this process, the shoe 301 and the soleplate 303 are pressed against each other. Then a laser beam is directed to the shoe 301 from above. This laser is advantageously an NdYAG laser. It causes melting of the shoe 301 in the area upon which the laser beam impinges. Melting also occurs on the upper surface of the soleplate 303 material. The shoe 301 and the soleplate 303 thus coalesce at this location. Area 307 is the area surrounding this laser welded joint 308. This prevents adhesive material from adversely affecting the welded joint.

Adjoining the area 307 is the area 304 in which a layer of adhesive is present between the shoe 301 and the soleplate 303. In the transition region from the area 304 to the area 307, an overflow channel 309 for receiving adhesive material is arranged. In the event of an excessive amount of adhesive being applied, this excess adhesive material would be urged, for example, also into the area 307 when the shoe 301 and the soleplate 303 are pressed together. This could have a detrimental effect on the welded joint. The overflow channel 309 serves to obviate this risk. Excess adhesive can be received by this overflow channel 309. The overflow channel 309 is thus not completely filled with adhesive. In the direction of the outer edge of the smoothing surface, the area 304 is adjoined by the area 306 in which direct contact exists between the shoe 301 and the soleplate 303. The adhesive used is of the type containing silicone and has comparatively good heat transfer properties. Yet this heat transfer is still worse than the heat transfer at the locations of direct contact between the shoe 301 and the soleplate 303. In addition, this area 306 has the effect of largely preventing the soleplate 303 from being deflected in convex fashion as it is attached to the shoe 301. In the absence of a support in the area 306, the shoe 303 would be without an abutment because of the elasticity of the adhesive layer.

A circumferential steam discharge duct 302 is arranged adjacent to the area 306 in the direction of the outer edge of the smoothing surface. This steam discharge duct 302 communicates with a steam generating chamber (not shown). After the water is changed to steam in the steam generating chamber, the steam enters the steam discharge duct 302. The soleplate 303 includes holes (not shown) disposed along the length of the steam discharge duct 302, through which holes the steam may escape to strike the article being ironed.

In the direction of the outer edge of the smoothing surface, the steam discharge duct 302 is adjoined by the area 305 in which an adhesive layer is present between the shoe 301 and the soleplate 303. The adhesive layer in the area 305 is of greater thickness than the adhesive layer in the area 304.

Thus, when a concave deflection of the soleplate 303 occurs by reason of a coefficient of thermal expansion of the coating of the soleplate 303 that is lower than the coefficient of thermal expansion of the soleplate 303, a reduced mechanical resistance operates in opposition to this concave deflection at the outer edge of the smoothing surface because of the higher elasticity of the adhesive layer there. The mechanical load imposed on the adhesive layer is thereby reduced.

A distance of between 0.1 and 0.2 mm, approximately, in particular 0.15 mm, has proven to be suitable between the shoe and the soleplate in the area filled with adhesive and in which this distance is the smallest. Advantageously, the distance between the shoe and the soleplate is between 0.5 and 1.0 mm, approximately, in particular between 0.6 and 0.8 mm, in the area filled with adhesive and in which this distance is the largest. In the areas filled with adhesive completely, a ratio of the largest distance to the smallest distance of 5 to 10, approximately, results.

We claim:

1. A smoothing iron comprising:

a shoe and a soleplate connected to a face of the shoe by an adhesive, wherein the face of the shoe and the soleplate are spaced apart and define a gap which has different distance values at different locations over the face of the shoe and wherein a volume defined by said gap is filled with the adhesive.

2. The smoothing iron as claimed in claim 1, wherein the distance values increase from a center portion of said face of the shoe towards marginal edges of said face along a first imaginary line extending essentially parallel to a longitudinal direction of the smoothing iron.

3. The smoothing iron as claimed in claim 2, wherein the shoe and the soleplate are secured together by mechanical fastening means in at least one location on the second imaginary line.

4. The smoothing iron as claimed in claim 3, wherein said mechanical fastening means is a laser weld.

5. The smoothing iron as claimed in claim 2, wherein said imaginary line extends at least approximately through the area center of gravity of said face of the shoe.

6. The smoothing iron as claimed in claim 1, wherein the distance values increase from a center portion of said face of the shoe towards marginal edges of said face along a second imaginary line extending essentially perpendicular to a longitudinal direction of the smoothing iron.

7. The smoothing iron as claimed in claim 6, wherein said second imaginary line extends at least approximately through the area center of gravity of said face.

8. The smoothing iron as claimed in claim 2, wherein the shoe and the soleplate are secured together by mechanical fastening means in at least one location on the first imaginary line.

9. The smoothing iron as claimed in claim 8, wherein said mechanical fastening means is a laser weld.

10. The smoothing iron as claimed in claim 1, said face of the shoe further comprising steps, wherein the distance values change discontinuously across said steps.

11. The smoothing iron as claimed in claim 1, wherein the gap distance values smoothly across the face of the shoe.

12. The smoothing iron as claimed in claim 1 wherein the shoe and the soleplate are in direct contact with each other at at least one individual location on said face of the shoe.

13. The smoothing iron as claimed in claim 1, wherein the face of the shoe is shaped to produce said different distance values.

14. The smoothing iron as claimed in claim 1, the shoe further comprising a downwardly open circumferential steam distribution duct extending essentially parallel to at least lateral longitudinal edges of the shoe, wherein in an outer area between the steam distribution duct and the lateral longitudinal edge of the shoe the distance values between the shoe and the soleplate are greater than in an inner area disposed within the boundary of the circumferential steam distribution duct.

15. The smoothing iron as claimed in claim 14, wherein at a location of the inner area adjoining an inner boundary of the steam distribution duct the shoe and the soleplate are in direct contact with each other.

* * * * *